US009261341B2

(12) United States Patent
Chiu et al.

(10) Patent No.: US 9,261,341 B2
(45) Date of Patent: Feb. 16, 2016

(54) SILICIDED MOS CAPACITOR EXPLOSIVE DEVICE INITIATOR

(71) Applicant: WaferTech, LLC, Camas, WA (US)

(72) Inventors: Re-Long Chiu, Vancouver, WA (US); Sharon Ying, Camas, WA (US)

(73) Assignee: WAFERTECH, LLC, Camas, WA (US)

( * ) Notice: Subject to any disclaimer, the term of this patent is extended or adjusted under 35 U.S.C. 154(b) by 3 days.

(21) Appl. No.: 14/333,769

(22) Filed: Jul. 17, 2014

(65) Prior Publication Data

US 2015/0007739 A1 Jan. 8, 2015

Related U.S. Application Data

(62) Division of application No. 12/950,289, filed on Nov. 19, 2010, now Pat. No. 8,794,151.

(51) Int. Cl.

| | |
|---|---|
| ***F42D 1/045*** | (2006.01) |
| ***F42B 3/10*** | (2006.01) |
| ***F42B 3/13*** | (2006.01) |
| ***F42C 19/12*** | (2006.01) |
| ***F42C 19/08*** | (2006.01) |

(52) U.S. Cl.

CPC . *F42D 1/045* (2013.01); *F42B 3/10* (2013.01); *F42B 3/13* (2013.01); *F42C 19/0811* (2013.01); *F42C 19/12* (2013.01)

(58) Field of Classification Search

CPC ..... F42C 19/08; F42C 19/0811; F42C 19/12; F42C 11/00; F42B 3/10; F42B 3/12; F42B 3/13; F42D 1/045

USPC ..... 102/200, 202, 202.5, 202.6, 202.7, 102/202.8, 202.9, 202.11, 205, 206, 218

See application file for complete search history.

(56) References Cited

U.S. PATENT DOCUMENTS

| | | | |
|---|---|---|---|
| 3,366,055 | A | 1/1968 | Hollander, Jr. |
| 4,708,060 | A | 11/1987 | Bickes, Jr. et al. |

(Continued)

FOREIGN PATENT DOCUMENTS

JP 2007165424 A * 6/2007

OTHER PUBLICATIONS

Bickes et al., "Semiconductor Bridge, SCB, Ignition of Energetic Materials," *Western State Section/The Combustion 1997 Spring Meeting*, Apr. 14-15, 1997, Livermore, California, CONF-970495-1, 18 pages.

Bickes et al., "Characterization of Semiconductor Bridge (SCB) Igniters for Use in Thermal Batteries," Sandia National Laboratories, Albuquerque, New Mexico, *37th Power Sources Conference: Hilton at Cherry Hill (NJ)*, Jun. 17-20, 1996, 4 pages.

(Continued)

*Primary Examiner* — James S Bergin

(74) *Attorney, Agent, or Firm* — Duane Morris LLP

(57) ABSTRACT

An explosive device using a semiconductor explosion initiator device provides an MOS capacitor formed on a semiconductor substrate and including a silicide layer formed over a doped silicon layer formed over an oxide layer. The oxide layer is formed on an N-well formed in a semiconductor substrate. A voltage source applies a voltage which may be a pulsed voltage, across the MOS capacitor sufficient to cause the avalanche breakdown of the oxide layer and the diffusion of metal from the silicide layer into the doped silicon of the N-well formed in the substrate. The chemical reaction between the metal and the doped silicon causes the generation of a plasma which ignites a pyrotechnic material or ignites or detonates other explosive material in contact with the semiconductor explosion initiator device.

20 Claims, 3 Drawing Sheets

(56) References Cited

U.S. PATENT DOCUMENTS

| | | | | |
|---|---|---|---|---|
| 4,976,200 | A | 12/1990 | Benson et al. | |
| 5,072,266 | A | 12/1991 | Bulucea et al. | |
| 6,281,080 | B1 | 8/2001 | Tung | |
| 8,794,151 | B2 * | 8/2014 | Chiu et al. | 102/202.5 |
| 2012/0132096 | A1 | 5/2012 | Chiu et al. | |

OTHER PUBLICATIONS

Author Unknown, "Semiconductor igniter makes multiple air bags likelier—Sandia National Laboratories, Albuquerque, New Mexico," *Sandia Science News*, Jul. 1991, 3 pages.

* cited by examiner

SILICIDED MOS CAPACITOR EXPLOSIVE DEVICE INITIATOR

RELATED APPLICATION

This application is a divisional application of U.S. patent application Ser. No. 12/950,289, filed on Nov. 19, 2010, the contents of which are incorporated herein by reference as if set forth in their entirety.

TECHNICAL FIELD

The present invention relates to semiconductor devices that initiate explosions.

BACKGROUND

Explosive devices and explosively activated devices have been developed and are used to perform many functions today. For example, airbags in automobiles and other motor vehicles are explosively activated devices and explosively activated devices are also used extensively in mining, excavation, rocket ignition and various other firing systems. In each explosively activated device, the explosion must be initiated and this is typically done by ignition or detonation.

Explosive devices typically fall into two or more basic groups. The first group is electro-thermally initiated devices which respond to relatively low electrical energies. The second group is electro-shock initiated devices which include exploding wire and foil designs requiring very high energy levels. While electro-shock initiated devices have the advantages of fast and repeatable function times and also exhibit a very high resistance to inadvertent initiation, they normally require high initiation energies and power levels which lead to larger and more expensive electrical firing systems.

Electro-thermally initiated devices therefore enjoy the advantage of operating at lower initiation energies and can be smaller and easier to produce. The ignition systems and devices used to activate these explosively activated devices should desirably be easy to ignite, compact, efficient, easy to manufacture, reliable and should include safeguards against undesirably igniting.

Although various ignition systems for electro-thermally initiated devices exist, it would be desirable to produce smaller ignition devices with smaller features and which can be heated or otherwise activated much faster and using less energy than conventional devices. It would also be desirable to produce such devices to include safeguards against undesirable ignition. It would further be desirable to manufacture such miniaturized ignition devices using well known and well understood conventional methods that allow for simultaneously manufacturing multiple devices in a small area.

BRIEF DESCRIPTION OF THE DRAWING

The present invention is best understood from the following detailed description when read in conjunction with the accompanying drawing. It is emphasized that, according to common practice, the various features of the drawing are not necessarily to scale. On the contrary, the dimensions of the various features may be arbitrarily expanded or reduced for clarity. Like numerals denote like features throughout the specification and drawing.

DETAILED DESCRIPTION

Disclosed is an explosive semiconductor device that includes a semiconductor explosion initiator device that may be manufactured using conventional MOS manufacturing operations and materials, explosive materials and a voltage source. The electro-explosive semiconductor device is efficient at converting electrical energy to chemical energy that triggers an explosion and produces explosive energy.

The semiconductor explosion initiator devices of the disclosure are characterized by their low firing energy, less than 1 mJ (milijoule) in many instances, fast function times, i.e. less than 10 μs, reliability and ease of manufacture. When a voltage is applied access the device using a voltage source such as a charge pump, and the voltage is sufficient to break down the oxide of the semiconductor explosion initiator device, a plasma is produced which initiates the explosion of explosive materials such as by igniting conventional pyrotechnics or causing the ignition or detonation of other explosive material in contact with the semiconductor explosion initiator device. The plasma discharge caused by the migration of metal species through the dielectric and into a doped silicon material, heats the exoergic explosive material contacting the semiconductor explosion initiator device by a convective process that is both rapid and efficient. In one embodiment, the metal from the silicide reacts with a phosphorus dopant. Since the semiconductor explosion initiator device is formed on a semiconductor substrate, the substrate provides a very large and reliable heat sink for excellent no-fire levels.

A plurality of semiconductor explosion initiator devices and/or other devices may be formed in close proximity on the semiconductor substrate and they may be wired together either in series or in parallel. The individual devices may be coupled using conductive materials formed on the substrate using conventional deposition and patterning techniques. Additionally, the devices formed on the semiconductor substrate may be formed to be ESD (electrostatic discharge) and RF (radio frequency) tolerant.

Figure 1:
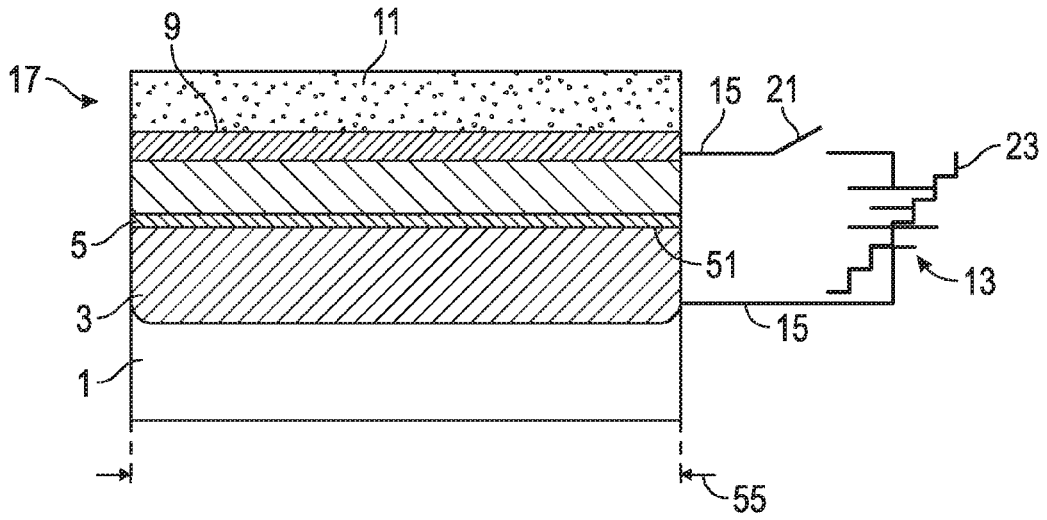
FIG. 1 illustrates an exemplary explosive device and includes a cross-sectional view of an exemplary semiconductor explosion initiator device.

FIG. 1 illustrates an exemplary explosive device and includes a cross-sectional view of an exemplary semiconductor explosion initiator device according to one exemplary embodiment of the disclosure. The semiconductor explosion initiator device and each of the components thereof may be fabricated using conventional metal-oxide-semiconductor, MOS, fabrication techniques used to manufacture semiconductor integrated circuit devices. Semiconductor substrate 1 may be formed of silicon, silicon germanium, or other suitable and conventional materials. Semiconductor substrate 1 may be an N-type or P-type semiconductor substrate and according to one advantageous embodiment, semiconductor substrate 1 is a P-type silicon substrate. N-well 3 is formed within semiconductor substrate 1 and extends to upper interface surface 51. N-well 3 may be formed by ion implantation or other means. N-well 3 may be doped with various N-type materials such as phosphorous and according to one exemplary embodiment, the dopant concentration of N-well 3 may range from about $1\times10^{12}$ to $1\times10^{22}$ atoms per square centimeter. Other dopant species and concentrations may be used in other exemplary embodiments.

Oxide layer 5 is formed on N-well 3 and may be silicon dioxide according to one exemplary embodiment but other oxides or other dielectrics may be used in other exemplary embodiments. Oxide layer 5 may be formed by thermal oxidation or by other procedures. Oxide layer 5 may include a thickness of about 10-300 angstroms in various exemplary embodiments but other oxide thicknesses may also be used and the oxide thickness will at least partially determine the voltage level used to ignite the plasma that initiates the explosion of the explosive semiconductor device. More particularly, oxide layer 5 will be chosen to have a breakdown voltage chosen in conjunction with a voltage source that will be used to break down oxide layer 5. In various exemplary embodiments, oxide layer 5 may be a gate oxide and this gate oxide may be formed over other portions of semiconductor substrate 1 not illustrated in FIG. 1. Oxide layer 5 may serve as a gate oxide for transistors and other devices that may be formed on semiconductor substrate 1 but which are not shown in FIG. 1.

Doped silicon layer 7 is formed over oxide layer 5. Doped silicon layer 7 may include various suitable thicknesses and may be a polysilicon layer, an amorphous silicon layer, a silicon germanium layer or other suitable silicon material layers. Doped silicon layer 7 is advantageously doped with phosphorous in one exemplary embodiment. According to one exemplary embodiment, both N-well 3 and doped silicon layer 7 are doped with phosphorous to form substantially uniform oxide/silicon interfaces at opposed interface surfaces 51 and 53. Various doping levels may be used for doped silicon layer 7. Silicide layer 9 is formed on doped silicon layer 7. Like the other layers described herein, silicide layer 9 is formed using conventional semiconductor fabrication methods and materials and may be formed from a metal layer of W, Al, Ti, or Co or combinations thereof. Therefore, silicide layer 9 may be a layer of tungsten silicide, WSi, in one advantageous embodiment. Other silicide materials such as aluminum silicide, AlSi, titanium silicide, TiSi or cobalt silicide, CoSi or other suitable silicides, may be used in other exemplary embodiments. The semiconductor explosion initiator device includes at least semiconductor substrate 1, N-well 3, oxide layer 5, doped silicon layer 7 and silicide layer 9 in the illustrated embodiment but other layers and other materials may be used in other exemplary embodiments. The semiconductor explosion initiator device initiates the explosion of explosive material according to the various mechanisms described herein, but will be referred to hereinafter, simply as semiconductor ignition device 17.

Explosive material 11 is disposed over silicide layer 9 in the exemplary embodiment but this spatial arrangement is intended to be exemplary only and explosive material 11 may be disposed on the sides and/or ends of semiconductor ignition device 17 in other exemplary embodiments. Explosive material 11 is arranged such that it contacts semiconductor ignition device 17 sufficiently such that when a plasma is formed, explosive material 11 explodes. Explosive material 11 may include one or more of pentaerythritrol tetranitrate (PETN), cyclotrimethylene trinitramine (RDX), trinitrotoluene (TNT), trinitrophenylmethylnitramine (TETRYL), titanium sub-hydride potassium perchlorate, $TiH_{1.65}/KClO_4$ (THKP), hexanitrostilbene (HNS), and cyclotetramethylene tetranitramine (HMX), various pyrotechnic materials, sensitive primary materials and gunpowder.

Voltage source 13 is shown along with leads 15 and switch 21 schematically coupled to semiconductor ignition device 17 in FIG. 1. In the illustrated embodiment, one lead 15 is coupled to silicide layer 9 and the other lead 15 is coupled to N-well 3. In other exemplary embodiments, other arrangements may be used such that voltage source 13 applies a voltage across oxide layer 5. Conventional conductive materials may be used as wires for leads 15 and in one exemplary embodiment, at least a portion of leads 15 may include a layer of patterned conductive material formed on a surface of semiconductor substrate 1. Leads 15 may also include various other wires or conductive materials. Step function 23 is used to indicate that voltage source 13 may drive semiconductor ignition device 17 with a voltage pulse. Various voltage sources may be used.

When semiconductor ignition device 17 is driven with a voltage higher than the oxide breakdown voltage of oxide layer 5, an avalanche breakdown of oxide layer 5 occurs and high local heating burns silicide layer 9 causing metal from silicide layer 9 to diffuse through oxide layer 5 and into N-well 3. In N-well 3, the metal which may be W in one advantageous embodiment, reacts with the N-type dopant impurity such as phosphorous to cause a dense inert metal explosive (DIME) which vaporizes to form a plasma. The plasma generated by the chemical reaction in semiconductor ignition device 17 readily causes the explosion of explosive material 11 in contact with it, without the need for sensitizing mixture. The explosive material 11 may be a pyrotechnic material that the chemical reaction causes to ignite, or explosive material 11 may be other explosive material types that are detonated or ignited by the chemical reaction. The electrical energy provided by voltage source 13 is thus converted to explosive energy.

Various voltage levels may be applied to semiconductor ignition device 17 to cause the breakdown of oxide layer 5. In various exemplary embodiments, 1-100 volts may be used. Low energy levels such as 0.1 mJ to 5 mJ energy levels may be sufficient to create the plasma and initiate the explosion. The initiation process may produce fast ignition times that may range from 1 ns to 100 μs in various exemplary embodiments. In one embodiment, an explosion may be initiated by an energy of 0.01 milliJoules produced by application of a voltage of 10V causing a current of 1 mA for 1 millisecond. The total explosive energy produces by explosive material 11 will be determined by the type and quantity of explosive material 11.

According to one exemplary embodiment, voltage source 13 may be a charge pump that enables voltage amplification and can be used to produce a greater voltage, such as 8 volts, across oxide layer 5, even when voltage source 13 is operating at a lower voltage such as 1 volt. Charge pump devices are known in the art.

According to one exemplary embodiment, a charge pump device is a kind of DC to DC converter that may use capacitors as energy storage elements to create either a higher or lower voltage power source. Charge pump circuits are capable of high efficiencies, sometimes as high as 90-95% while being electrically simple circuits. Charge pumps may use some form of switching device(s) to control the connection of voltages to the capacitor. In various embodiments, to generate a higher voltage, the first stage may involve the capacitor being connected across a voltage and charged up. In the second stage, the capacitor is disconnected from the original charging voltage and reconnected with its negative terminal to the original positive charging voltage. Because the capacitor retains the voltage across it, the positive terminal voltage is added to the original, effectively doubling the voltage. The pulsing nature of the higher voltage output may be smoothed by the use of an output capacitor. This is the charge pumping action, which typically operates at tens of kilohertz up to several megahertz to minimize the amount of capacitance required. The capacitor used as the charge pump is typically known as the "flying capacitor".

Charge pumps can double voltages, triple voltages, halve voltages, invert voltages, fractionally multiply or scale voltages such as x3/2, x4/3, x2/3, etc. and generate arbitrary voltages, depending on the controller and circuit topology. In one exemplary embodiment, when voltage source 13 is a charge pump, a voltage of 8 volts may be generated using an operating voltage of 1 volt but other arrangements and other voltage sources may be used in other exemplary embodiments. Various conventional means may be used to operate voltage source 13.

FIG. 1 illustrates that semiconductor ignition device 17 essentially is an MOS capacitor as oxide layer 5 serves as the capacitor dielectric with N-well 3/semiconductor substrate 1 serving as one electrode and doped poly layer 7/silicide layer 9 forming the other electrode. Although illustrated in only two dimensions in FIG. 1, the MOS capacitor will include an area determined by width 55 and the depth of the MOS capacitor along the direction perpendicular to the plane of the cross-section illustrated in FIG. 1. The firing characteristics of semiconductor ignition device 17 are dependent upon and can be controlled by a number of factors including the dosage level of phosphorous or other dopant in N-well 3, the thickness of oxide layer 5, the thickness of silicide layer 9 and the area of the MOS capacitor.

Figure 2:
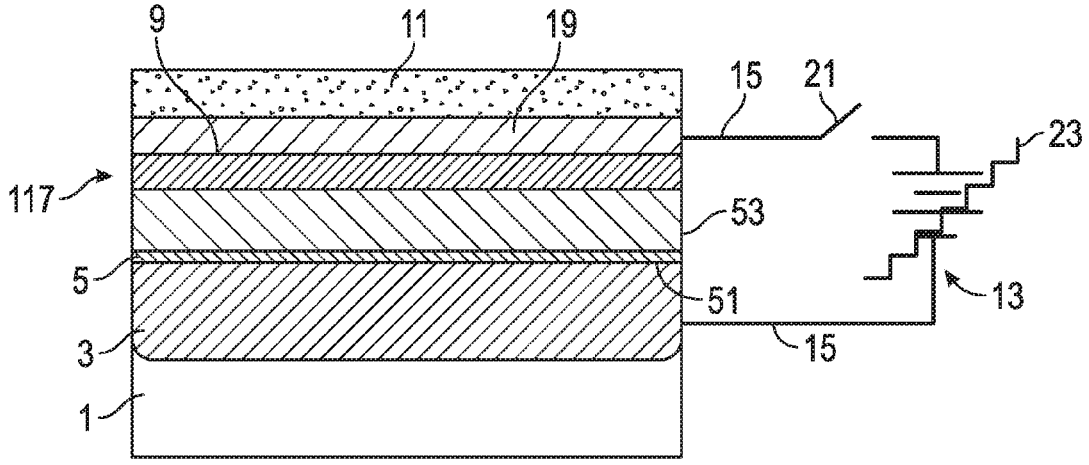
FIG. 2 illustrates another exemplary explosive device and includes a cross-sectional view of another exemplary semiconductor explosion initiator device.

FIG. 2 shows another exemplary semiconductor explosion initiator device referred to as semiconductor ignition device 117. Semiconductor ignition device 117 includes electrode layer 19 disposed over silicide layer 9. According to this exemplary embodiment, lead 15 of voltage source 13 is directly coupled to electrode layer 19 which is in contact with silicide layer 9. Electrode layer 19 may be formed of various suitable metal materials and it may be formed of the same or a different metal used to form silicide layer 9.

Figure 3:
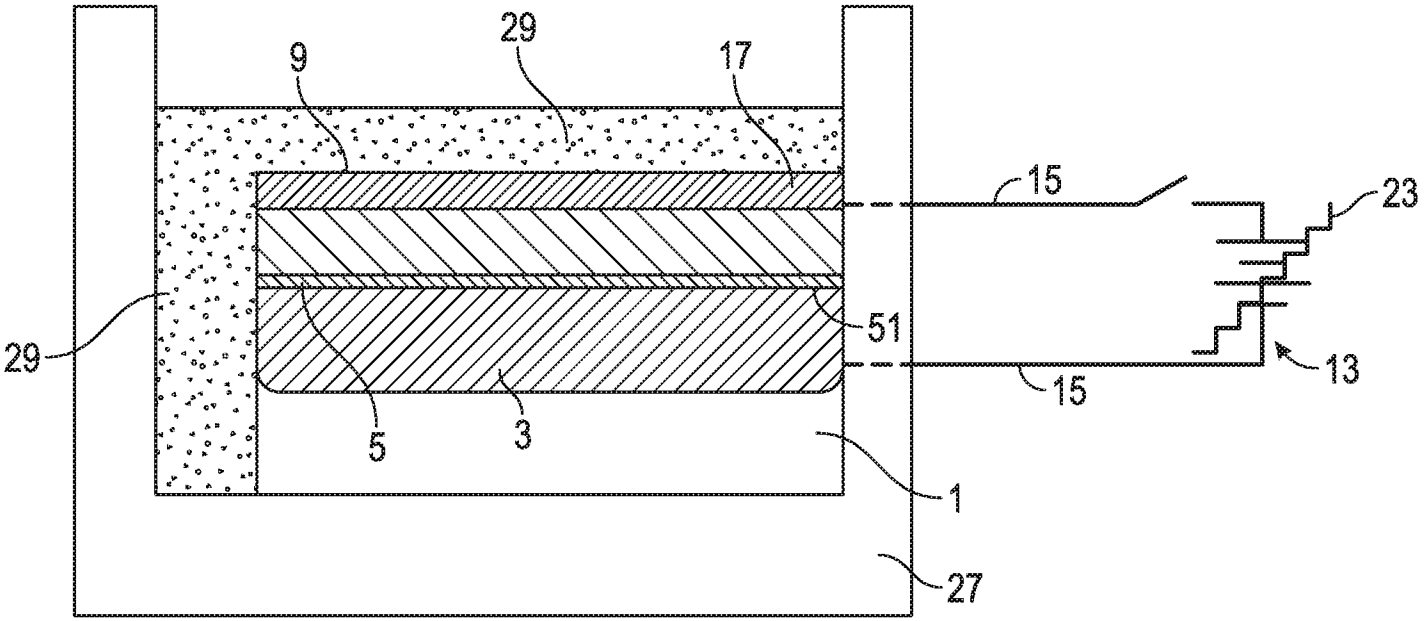
FIG. 3 illustrates yet another exemplary explosive device and includes a cross-sectional view of an exemplary semiconductor explosion initiator device.

FIG. 3 shows another exemplary embodiment of an explosive semiconductor device. The explosive semiconductor device includes a semiconductor explosion initiator device referred to as semiconductor ignition device 17 contained within housing 27 which also retains explosive material 29. Housing 27 may be formed of various suitable sturdy materials such as metal but other suitable materials may be used in other exemplary embodiments. According to this illustrated embodiment, explosive material 29 may be a powder but other suitable explosive materials may be used in other exemplary embodiments.

Figure 4:
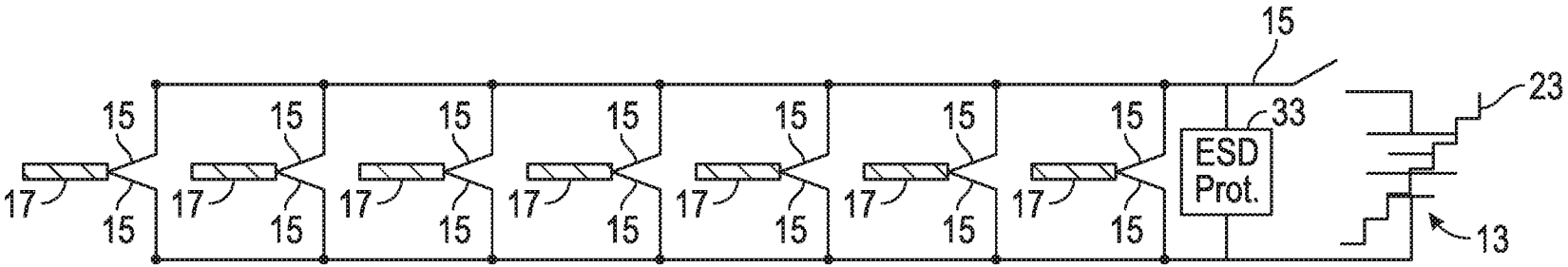
FIG. 4 is a schematic/circuit diagram showing one exemplary embodiment of a plurality of semiconductor explosion initiator devices according to the invention arranged in an exemplary parallel circuit.

One advantageous aspect of the present disclosure is that a plurality of the described semiconductor explosion initiator devices can be formed simultaneously on a substrate using conventional semiconductor fabrication processing techniques. The individual semiconductor explosion initiator devices may be coupled to one another using conductive leads formed using conventional semiconductor fabrication processing techniques and they may be wired in parallel or in series. FIG. 4 shows an exemplary parallel circuit including a plurality of semiconductor ignition devices 17 coupled to voltage source 13 using plural leads 15. The devices, coupled in parallel or in series may also be coupled to one or more ESD protection devices such as ESD protection device 33 also formed on the semiconductor substrate. Various other control circuits and other semiconductor devices may also be formed on the substrate together with the explosive semiconductor device or devices.

The disclosure also provides a method for initiating the explosion of an explosive device using a semiconductor explosion initiator device. The method includes providing one or more of the previously described explosive devices including the semiconductor explosion initiator device and voltage source, and applying a voltage across the oxide layer sufficient to cause the breakdown of the oxide layer, i.e. a voltage that exceeds the breakdown voltage of the associated oxide. The method also includes causing the ensuing phenomena as previously described, including the diffusion of metal from the silicide layer through the oxide layer and into the N-well where the metal reacts with the dopant materials to form a plasma that ignites or detonates the pyrotechnic or other explosive material that is in contact with the semiconductor ignition device.

In summary, in one aspect, the disclosure provides an explosive semiconductor device comprising a semiconductor explosion initiator device comprising an N-type well formed in a semiconductor substrate, an oxide layer disposed over the N-type well, a phosphorous doped silicon layer disposed over the oxide layer and a silicide material layer disposed on the phosphorous doped silicon layer. The explosive semiconductor device also comprises a voltage source coupled to the semiconductor explosion initiator device and capable of providing a voltage across the N-type well and the silicide material layer; and an explosive material contacting the semiconductor explosion initiator device.

According to another aspect, the disclosure provides a method for causing an explosion using a semiconductor ignition device. The method comprises: providing a semiconductor ignition device comprising an N-type well formed in a semiconductor substrate, an oxide layer formed over the N-type well, a phosphorous doped silicon layer over the oxide layer, and a silicide material layer formed on the phosphorous doped silicon layer; and applying a voltage across the oxide layer sufficient to cause metal from the silicide to break through the oxide layer and cause the explosive material to be exploded.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed to furthering the art, and are to be construed as being without limitation to such specifically recited examples and conditions. Moreover, all statements herein reciting principles, aspects, and embodiments, as well as specific examples, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents.

What is claimed is:

1. A method for initiating an explosive reaction in a semiconductor ignition device, said method comprising:

providing a semiconductor ignition device comprising an N-type well formed in a semiconductor substrate, an oxide layer formed over said N-type well, a phosphorous doped silicon layer over said oxide layer, and a silicide material layer formed on said phosphorous doped silicon layer; and applying a voltage across said oxide layer sufficient to cause metal from said silicide material layer to break through said oxide layer and diffuse into said N-type well and react with dopants in said N-type well to initiate said explosive reaction.

2. The method as in claim 1, further comprising disposing an explosive material contacting said semiconductor ignition device and wherein said applying a voltage across said oxide layer causes said metal to react-with said dopants in said N-type well and initiate said explosive reaction by producing a plasma that ignites said explosive material.

3. The method as in claim 2, wherein said applying a voltage comprises applying a pulsed voltage.

4. The method as in claim 2, wherein said semiconductor ignition device comprises said N-type well including phosphorous therein at a concentration of about 1E12-1E22 atoms/$cm^2$, said silicide material layer includes at least one of W, Al, Ti, and Co, said oxide layer includes a thickness of about 10-300 angstroms and said applying comprises using a charge pumping device to provide a pulsed voltage.

5. The method as in claim 2, wherein said explosive material comprises a powder disposed in a housing that further contains said semiconductor substrate.

6. The method as in claim 2, wherein said explosive material comprises at least one of THKP, PETN, HNAB, HMX, RDX, TNT, a pyrotechnic material, a sensitive primary material, and gunpowder.

7. The method as in claim 1, wherein said applying a voltage comprises applying a voltage that exceeds a breakdown voltage of said oxide.

8. The method as in claim 1, wherein said applying a voltage comprises applying a pulsed voltage.

9. The method as in claim 1, wherein said applying a voltage across said oxide layer causes said metal to react with phosphorus dopants in said N-type well and produce a plasma that ignites an explosive material contacting said semiconductor ignition device.

10. The method as in claim 9, wherein said explosive material comprises a powder.

11. A method for initiating a reaction in a semiconductor ignition device, said method comprising:

coupling a voltage source to a semiconductor structure that includes an oxide layer and metal in a silicide contact layer on one side of said oxide layer, and is coupled to an explosive material; and applying a voltage across said semiconductor structure sufficient to cause said metal from said one side of said oxide layer to break through said oxide layer, react with dopants in an N-type material in a semiconductor layer on an opposed side of said oxide layer and produce a plasma that ignites said explosive material.

12. The method as in claim 11, wherein said explosive material comprises at least one of THKP, PETN, HNAB, HMX, RDX, TNT, a pyrotechnic material, a sensitive primary material, and gunpowder.

13. The method as in claim 12, wherein said silicide contact layer is disposed on a phosphorous doped silicon layer disposed on said oxide layer and said applying a voltage includes directly coupling a lead of a voltage source to said silicide contact layer.

14. The method as in claim 11, wherein said semiconductor structure comprises said N-type material being an N-type well formed in a substrate and including phosphorous therein at a concentration of about 1E12-1E22atoms/$cm^2$, said metal comprises at least one of W, Al, Ti, and Co, said oxide layer includes a thickness of about 10-300 angstroms and said applying a voltage comprises providing a pulsed voltage using a charge pumping device.

15. A method for initiating a reaction in a semiconductor ignition device, said method comprising:

providing a semiconductor ignition device comprising an N-type well formed in a semiconductor substrate, an oxide layer formed over said N-type well, a phosphorous doped silicon layer over said oxide layer, and a silicide material layer formed on said phosphorous doped silicon layer; and applying a voltage across said oxide layer sufficient to cause metal from said silicide material layer to break through said oxide layer and diffuse into said N-type well, disposing an explosive material contacting said semiconductor ignition device and, wherein said applying a voltage across said oxide layer causes said metal to react with said dopants in said N-type well and produce a plasma that ignites said explosive material.

16. The method as in claim 15, wherein said explosive material comprises at least one of THKP, PETN, HNAB, HMX, RDX, TNT, a pyrotechnic material, a sensitive primary material, and gunpowder.

17. The method as in claim 15, wherein said semiconductor ignition device comprises said N-type well including phosphorous therein at a concentration of about 1E12-1E22 atoms/$cm^2$, said silicide material layer includes at least one of W, Al, Ti, and Co and said oxide layer includes a thickness of about 10-300 angstroms.

18. The method as in claim 15, wherein said applying a voltage comprises using a charge pumping device to provide a pulsed voltage.

19. The method as in claim 15, wherein said applying a voltage comprises using a voltage source that operates at a voltage of about 1 volt and said voltage source delivering a pulsed voltage of about 8 volts across said oxide layer, and wherein said N-type well comprises a phosphorous doped silicon layer.

20. The method as in claim 15, wherein said applying a voltage includes directly coupling a lead of a voltage source to said silicide material layer.

* * * * *